United States Patent [19]

Schmode et al.

[11] Patent Number: 4,982,630

[45] Date of Patent: Jan. 8, 1991

[54] PLIERS-TYPE TOOL

[75] Inventors: Hartmut Schmode, Blomberg; Ulrich Wiebe, Dörentrup, both of Fed. Rep. of Germany; Hans Undin, Akersberga, Sweden

[73] Assignee: C. A. Weidmuller GmbH & Co., Detmold, Fed. Rep. of Germany

[21] Appl. No.: 433,479

[22] Filed: Nov. 9, 1989

[30] Foreign Application Priority Data

Nov. 11, 1988 [SE] Sweden ..... 8804083

[51] Int. Cl.[5] ..... B25B 7/12

[52] U.S. Cl. ..... 81/352; 81/346; 81/348

[58] Field of Search ..... 81/345–348, 81/342, 341, 111, 126, 385–387, 383, 406, 407, 392, 393, 352, 336–338

[56] References Cited

U.S. PATENT DOCUMENTS

D. 838,665 12/1906 Sutherland ..... 81/126

1,149,060 8/1915 Ingram ..... 81/345

1,180,446 4/1916 Sheldon ..... 81/126

1,519,938 12/1924 Smith ..... 81/345

1,638,703 8/1927 Pendleton ..... 81/111

*Primary Examiner*—Frederick R. Schmidt

*Assistant Examiner*—Bruce P. Watson

*Attorney, Agent, or Firm*—Cushman, Darby & Cushman

[57] ABSTRACT

In a pliers-type tool with a fixed jaw carrier (13A) and a movable jaw carrier (13B) arranged on a pivotable rocker (14) which is connected with an at least to a limited degree resiliently bendable bracket (15). The rocker (14) is with the aid of a pivot pin (14A) pivotally attached to a longitudinal tool body (11), the pivot pin (14A) passing through the rocker (14) in a hole which is larger than the diameter of the pivot pin (14A), and is anchored on one end of a short link (17), the other end of which link is attached to the said bracket (17).

Thus work pieces, having a size within certain limits, may be precisely treated.

9 Claims, 1 Drawing Sheet

PLIERS-TYPE TOOL

FIELD OF THE INVENTION

The present invention relates to a pliers-type tool of the kind stated in the preamble of claim 1. In tools of this kind is the bearing of the operating lever in the position of use located under the hand, which corresponds better to the opening width of the hand, and which, among other things, has the advantage that the operating lever may be immediately reached and grasped with the longest fingers of the hand even in the most open position of tool.

BACKGROUND OF THE INVENTION

A tool of this kind is described in the European patent application Ser. No. 89200565.3 (Swedish patent application Ser. No. 8801737-1). This known tool comprises the features indicated in the preamble of the enclosed claim 1, including a longitudinal tool body, at a first end of which is an operative part provided for treating a work piece e.g. by cutting or pressing, and which comprises two jaw carriers, at the opposed second end being an operating lever pivotally attached with the aid of a pivot pin, and a rigid driving rod connecting the operating lever with one of the jaw carriers.

The known tool is applicable in such instances, where the approaching motion of one jaw carrier toward the other one shall take place parallelly, the respective jaw carrier, mounted on a slide which is rectilinearily movable in the tool body, being affected by the driving rod. The known tool is further provided with a locking mechanism preventing premature interruption of the closing motion of the movable jaw carrier.

It is an object of the present invention to provide a pliers-type tool of the kind stated above, in which the approaching movement of one of the jaw carriers is scissors-like (i.e. a pivotal motion), which has a more simple, and more ergonometrically convenient construction, and in which work pieces in various sizes (within a certain range) may be precisely treated in one and the same end position of the jaw carriers.

A tool according to the invention, with crimping dies mounted on the jaw carriers, may be used e.g. as a pair of front-input crimping pliers which are operable with a small strength in the hand, and which in particular are suited for crimping so-called Aderend sleeves in accordance with European Standard in a range of of cross-sectional areas of approximately 0,25 $mm_2$ to 1,5 $mm^2$.

The invention is characterized by features indicated in the characterizing part of the enclosed patent claim 1, and preferred further developments are comprised in the subclaims.

SHORT DESCRIPTION OF THE DRAWINGS

The invention shall now be described more in detail with the aid of the enclosed schematical drawings, in which FIG. 1 is a side view of the tool according to the invention in open position and with removed outer casing;

DETAILED DESCRIPTION OF THE INVENTION

A tool according to the invention, and as shown in FIGS. 1 to 4, has an elongated tool body 11, on the first end 11A of which is an operative part provided, and at the opposite other end 11B of which there is operating lever 12 pivotally attached with the aid of a first pivot pin 11C.

The operative part comprises a first jaw carrier 13A which is firmly attached to the first end 11A of the tool body 11, and preferably is made in one piece therewith, and a movable second jaw carrier 13B. The second jaw carrier is 13B is rigidly connected with a rocker 14, and is preferably made in one piece therewith.

The rocker 14 is with the aid of a second pivot pin 14A journalled to the tool body 11 in a manner which will be explained more in detail below.

Each jaw carrier 13A, 13B carries, possibly in an exchangeable manner, an operative means, e.g. one of the above said crimping dies, which for clarity are not shown, and for the attachment of which (with the aid of screw bolts or the like) there are holes A provided in the jaw carriers.

The operative part is located in a portion of the tool body 11 which is bent upward (i.e. in the direction from which the operating lever 12 is attached). The operating lever 12 has at its attachment end a bent broader part 12', where the first pivot pin 11C is located.

Figure 3:
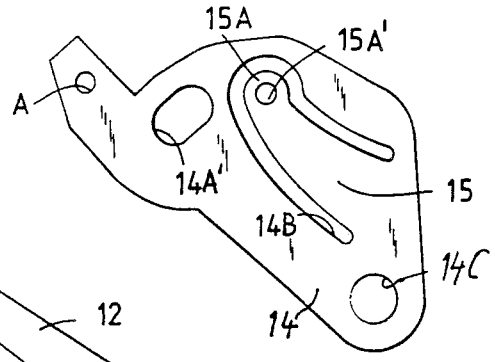
FIG. 3 is a view of a rocker in the tool of FIGS. 1 and 2 at a larger scale (and in laterally reversed position relative to FIGS. 1 and 2)
Figure 1:
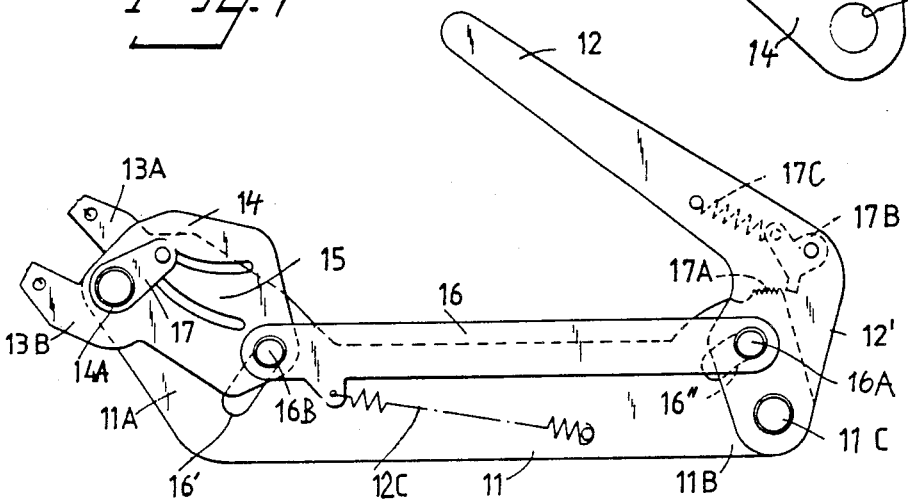
Figure 2:
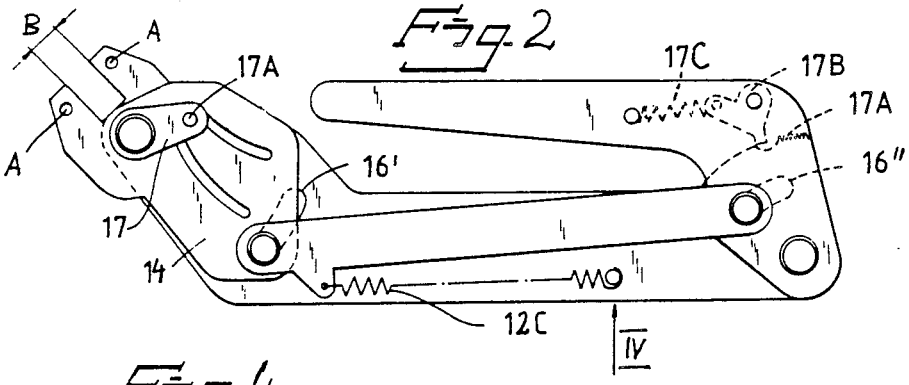
FIG. 2 is a view of the tool of FIG. 1 in closed position.

A rigid driving rod 16 is at its first end attached to the operating lever 12 (within the broader part 12' thereof) with the aid of a first connecting pin 16A, and is at its other end connected to the rocker 14 (spacedly from the second pivot 14A) with the aid of a second connecting pin 16B. The driving rod 16 extends substantially parallel with the tool body 11, in particular in the closed position of the tool (FIG. 2).

Figure 4:
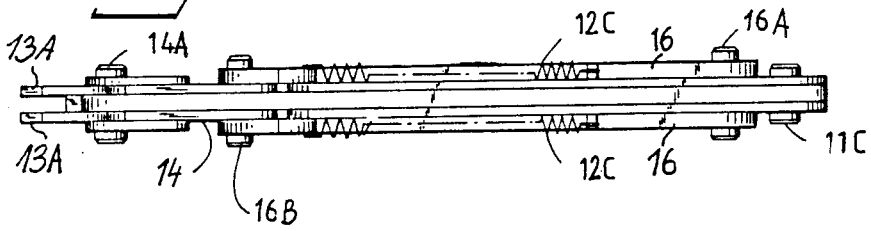
FIG. 4 is a view of the tool of FIG. 2 in the sense of arrow IV in FIG. 2.

The tool body (together with the first jaw carrier 13A) is preferably embodied by a flat, longitudinal plate, and the rocker 14 (together with the second jaw carrier 13B), as well as the driving rod 16, are, in accordance with FIG. 4, preferably doubled in such manner that one piece (member) is located on each side of the tool body 11, and is by means of the said pivot and connecting pins 14A, 16A, 16B attached to its counterpart. The two jaw carriers 13B, the two rockers 14, and the two driving rods 16 define thus a jaw carrier means 13B, a rocker means 14, and a driving rod means 16 comprising two jaw carriers, two rockers, and two driving rods respectively.

Circular arcuate slots 16', 16'' in the tool body 11, having their centres of curvature in the pivot pins 14A, 11C, allow for the connecting pins 16A, 16B to pass through the tool body 11. At least one of the slots 16', 16'' may by its length define an end stop means limiting the pivotal motion of the rocker 14 and/or of the operating lever 12 about the respective pivot pin 14A or 11C.

The operating lever 12 is fork-like shaped at its attachment end, and straddles the tool body 11 with its two legs. The first pivot pin 11C is mounted in the legs of the operating lever 12, and in the tool body 11, with the aid of circular holes having a size corresponding to the diameter of the pin.

A tension spring 12C (or, more correctly, one tension spring on each side of the tool body 11), operating between the the driving rod 16 and the tool body 11, tends to hold the tool in open position, i.e. with the operating lever 12 fully swung out, and the jaw carriers 13A, 13B maximally spaced apart.

The tool body 11 is, together with the component parts carried by it (with the exception of the jaw carriers and the operating lever), preferably enclosed in an outer casing in the the shape of a handle and e.g. embodied by two handle shells bounded together along a longitudinal plane of symmetry of the tool. This casing is not shown in the drawing for clarity; its periphery follows substantially (with a certain addition) the outline of the tool body 11 as shown in the drawing.

A compensation spring means, embodied by a bracket 15, which has a free end 15A, and which may at least to a limited degree be resiliently bent in a direction parallel with said plane of symmetry (i.e. substantially in the drawing plane of FIGS. 1 to 3) and transversely to the longitudinal direction of the tool body 11 (i.e. substantially downward in FIGS. 1 to 3), is rigidly attached to the rocker 14.

Such a resilient bracket may preferably, as the case is with a base plate in a mechanical clock work (where, however, resiliency in the above sense is not required), and as is shown in the drawing, by means of a conveniently shaped out, penetrating through the entire thickness of the rocker 14, be made in one piece with the rocker 14, if this one is made of a material (such as steel plate) with convenient properties.

At the free end 15A of the resilient bracket 15 is an opening 15A' provided in which is a retainer bolt 17A mounted, with the aid of which a short link (or bridge) 17 is at one its end attached to the rocker 14. The link 17 has at its other end a circular hole with the same diameter as the second pivot pin 14A, which is mounted therein. On the other hand, a hole 14A' (preferably a longitudinal opening) is arranged in the rocker 14 for the passage of the pivot pin 14A, which is larger than the diameter of the pivot pin 14A, so that this pin can to a certain degree freely move in the hole 14A'. Consequently, the rocker 14 is in no way rigidly and/or immediately attached to its pivot pin 14A.

By this arrangement is achieved that various end spacements B (FIG. 2) may be steplessly bridged over. By "end spacement" is understood the mutual spacement of the jaw carriers 13A, 13B (in the region of their free ends) in their end position (this term will be explained below). The practical result of this is that objects of various sizes (within certain limits), e.g. Aderend sleeves within the above mentioned cross-sectional range, can be treated, without the need of re-setting the tool, between jaws attached to the jaw carriers.

In the preferred embodiment, where among other parts also the rocker means 14 comprises one member on each side of the tool body 11, passes the second pivot pin 14A through the tool body 11 in a circular hole with a diameter corresponding to that of the pin, while for the attachment bolt 17A is a considerably larger opening (possibly a circular slot having its centre of curvature in the pin 14A), not visible in the drawing, provided in the tool body 11.

It will be appreciated, however, that in the instance that the second jaw carrier means, the rocker means, and the driving means in the tool are each defined by two members, one on each side of the tool body, each two respective members may also be journaled to the tool body 11 (and/or attached to the corresponding two members of some other, analogically constructed means) with the aid of pivot pins which do not pass through the tool body 11, but either are affixed to the tool body's lateral face, or terminate shortly before this face.

On the other end 11B of the tool body is a short, arcuate row of teeth 17A provided, which together with a spring-affected (tension spring 17C) pawl 17B, which is pivotally mounted on the operating lever 17, defines a locking mechanism of a kind known per se for preventing premature opening of the jaw carriers 13A, 13B.

Such a locking mechanism has the task to prevent that a work operation be not completely finished, and is to this purpose arranged to allow a return movement of the operating lever 12, and thus also of the jaw carrier 13B, first when the operating lever 12 has reached a predetermined end position, shown in FIG. 2 (and which possibly may be distinctly defined by the above mentioned end stop means), and in which the jaw carrier 13B is located at a predetermined end spacement B from the jaw carrier 13A.

It is therefore particularly advantageous that, when such a locking mechanism is provided, the end spacement is automatically adjustable within certain limits thanks to the construction of the rocker 14 according to the present invention. The invention may, however, with advantage also be applied in tools without a locking mechanism, by "end position" being in general understood the position of greatest mutual approachment of the two jaw carriers, defined e.g. by handles knocking against each other, or the like.

What is claimed is:

1. A pliers-type tool comprising:

a longitudinal tool body having a first end and a second end, an operative part being provided at said first end of said tool body for the treatment of a work piece, said operative part comprising a fixed first jaw carrier means and a movable second jaw carrier means, an operating lever pivotably attached to said second end of the tool body, driving rod means having a first end and a second end and pivotably attached at its first end to the second jaw carrier means, and at its said second end to said operating lever means so as to be affected thereby, the second jaw carrier means being arranged on a pivotable rocker means which with the aid of a pivot pin is rotatably mounted on the tool body and is rigidly connected with at least one bracket which is resiliently bendable in the plane of the rocker means, said bracket having a free end to which a first end of a link is connected, the pivot pin being attached to a second end of said link and passing through the rocker member in a hole which is larger than the diameter of the pivot pin, so that the mutual position of the rocker and its pivot pin is variable to the extent permitted by the resiliency of said bracket.

2. A pliers-type tool according to claim 1, characterized by said hole being defined by a longitudinal opening.

3. A pliers-type tool according to claim 1, characterized by the said bracket or brackets being made in one piece with the rocker means.

4. A pliers-type tool according to claim 3, characterized by the said bracket or brackets being cut out (14B) from the rocker means in a manner usual in clock work base plates.

5. A pliers-type tool according to claim 1, characterized by the first end of the tool body (11) with the operative part being bent in the same direction as the operating lever is attached from.

6. The tool of claim 1, wherein each of the second jaw carrier means, the rocker means, and the driving means consist of two members, one on each side of the tool body, and the two members defining each of the said means being interconnected by pins passing through the tool body, arcuate slots being provided in the tool body for the passage of the pins which interconnect the two members defining the driving means.

7. The tool of claim 1, provided with a position compelling mechanism for preventing premature opening of the two jaw carriers.

8. The tool of claim 7, wherein the motion compelling mechanism comprises an arcuate row of teeth at the second end of the tool body, and a co-operating, spring affected pawl which is pivotably mounted on the operating lever.

9. A pliers-type tool according to claim 1, wherein the tool is a pair of crimping pliers.

* * * * *